US010321724B2

(12) United States Patent
Bonin et al.

(10) Patent No.: US 10,321,724 B2
(45) Date of Patent: Jun. 18, 2019

(54) PERSONAL IMPACT PROTECTION DEVICE

(71) Applicant: WB Development Company LLC, Marlborough, MA (US)

(72) Inventors: Walter Bonin, Marlborough, MA (US); Glenn Jordan, Harvard, MA (US)

(73) Assignee: WB Development Company, LLC, Marlborough, MA (US)

( * ) Notice: Subject to any disclaimer, the term of this patent is extended or adjusted under 35 U.S.C. 154(b) by 0 days.

(21) Appl. No.: 13/766,828

(22) Filed: Feb. 14, 2013

(65) Prior Publication Data

US 2013/0212783 A1 Aug. 22, 2013

Related U.S. Application Data

(60) Provisional application No. 61/599,566, filed on Feb. 16, 2012.

(51) Int. Cl.
*A41D 13/015* (2006.01)
*A41D 13/06* (2006.01)
*A42B 3/06* (2006.01)

(52) U.S. Cl.
CPC ..... *A41D 13/015* (2013.01); *A41D 13/065* (2013.01); *A42B 3/064* (2013.01); *A42B 3/065* (2013.01)

(58) Field of Classification Search
CPC ..... A42B 3/064; A42B 3/125; A42B 3/128; A42B 3/00; A42B 3/06; A42B 3/08;
(Continued)

(56) References Cited

U.S. PATENT DOCUMENTS 1,104,808 A * 7/1914 Kookrow ..... A42B 3/06 2/411
1,199,629 A * 9/1916 Stocks ..... A42B 3/145 2/411
(Continued)

FOREIGN PATENT DOCUMENTS

CA 2568989 A1 * 1/2006 ..... A42B 3/32
EP 217996 A1 * 4/1987 ..... A42B 3/00
(Continued)

OTHER PUBLICATIONS

International Search Report and Written Opinion of the International Searching Authority issued in corresponding PCT Application No. PCT/US2013/026025 dated Apr. 19, 2013.
(Continued)

*Primary Examiner* — Anna K Kinsaul
(74) *Attorney, Agent, or Firm* — Duquette Law Group, LLC

(57) ABSTRACT

A personal impact protection device (10) with a first mechanical member (12) that may be a shell, ring or housing, and a second mechanical member (14) that may also be a shell, ring or housing. The two mechanical members (12, 14) are nested and spaced from one another. One or more elastomeric energy-absorption members (16) are mechanically coupled to and span the distance between both of the mechanical members (12, 14) to absorb energy from impacts to the outer mechanical member (12) that displace the outer member (12) relative to the inner member (14).

3 Claims, 19 Drawing Sheets

(58) Field of Classification Search
CPC .... A42B 3/12; A42B 3/14; A42B 3/28; A42B 3/322; A42B 3/0473; A42B 3/063; A42B 1/08; A63B 71/10
USPC ..... 2/411, 414, 6.8, 412, 416, 425, 9, 173, 2/417, 418, 419, 420, 421, 422
See application file for complete search history.

(56) References Cited

U.S. PATENT DOCUMENTS 1,244,559 A * 10/1917 Stocks ..... A42B 3/064 2/411
1,251,537 A 1/1918 Kempny
1,839,657 A * 1/1932 Duchek ..... A42B 3/14 2/414
1,868,926 A * 7/1932 Tatore ..... A42B 3/06 2/421
2,185,717 A * 1/1940 Wisman ..... A42B 3/14 2/416
2,250,275 A 7/1941 Riddell
2,306,362 A * 12/1942 Wolff ..... A42B 3/065 2/5
2,739,309 A * 3/1956 Frieder ..... A42B 3/06 2/416
2,758,305 A 8/1956 Gross
2,759,186 A * 8/1956 Dye ..... A42B 3/121 2/413
2,769,175 A * 11/1956 Barker, Jr. ..... A42B 3/14 2/416
2,805,419 A * 9/1957 Finken ..... A42B 3/166 2/416
2,822,546 A * 2/1958 Barker, Jr. ..... A42B 3/14 2/172
3,082,427 A * 3/1963 Zbikowski ..... A42B 3/14 2/416
3,237,201 A * 3/1966 Morgan ..... A42B 3/14 2/414
3,422,459 A * 1/1969 Bowers, Jr. ..... A42B 3/14 2/416
3,486,169 A * 12/1969 Rawlings ..... A42B 3/14 2/414
3,613,114 A * 10/1971 Hill et al. ..... A42B 3/10 2/416
3,616,463 A * 11/1971 Theodore et al. ..... A42B 3/063 2/412
3,820,163 A * 6/1974 Rappleyea ..... A42B 3/125 2/420
3,843,970 A * 10/1974 Marietta ..... A42B 3/127 2/415
3,872,511 A * 3/1975 Nichols ..... A42B 3/121 2/413
3,877,076 A * 4/1975 Summers ..... A42B 3/065 2/414
4,024,586 A * 5/1977 Lamb ..... A42B 3/124 2/414
4,035,847 A 7/1977 Prince et al.
4,044,399 A * 8/1977 Morton ..... A42B 3/127 2/414
4,051,555 A * 10/1977 Daly ..... A42B 3/127 2/412
4,055,860 A 11/1977 King
4,097,932 A 7/1978 Lacey
4,106,127 A * 8/1978 Marangoni ..... A42B 3/14 2/416
4,369,782 A * 1/1983 McGee ..... A42B 3/0406 2/410
4,407,021 A * 10/1983 Kralik ..... A42B 3/14 2/416
4,472,472 A * 9/1984 Schultz ..... A41D 31/005 428/178
4,613,993 A * 9/1986 Steele ..... A42B 3/00 112/421
4,710,984 A * 12/1987 Asper ..... A42B 3/063 2/412
4,751,920 A 6/1988 Mauldin et al.
5,044,016 A 9/1991 Coombs
5,068,922 A 12/1991 Zahn
5,101,517 A * 4/1992 Douglas ..... A42B 3/20 2/424
5,204,998 A * 4/1993 Liu ..... A42B 3/121 2/411
5,319,808 A * 6/1994 Bishop ..... A42B 3/14 2/181.2
5,444,870 A * 8/1995 Pinsen ..... A42B 3/0473 2/411
5,575,017 A * 11/1996 Hefling ..... A42B 3/145 2/418
5,599,288 A 2/1997 Shirley et al.
5,687,426 A * 11/1997 Sperber ..... A42B 3/061 2/411
5,707,347 A 1/1998 Bixler
5,713,082 A * 2/1998 Bassette ..... A42B 3/061 2/412
5,815,847 A * 10/1998 Holden, Jr. ..... A42B 3/125 2/414
5,950,244 A * 9/1999 Fournier ..... A42B 3/128 2/411
5,953,761 A * 9/1999 Jurga ..... A42B 3/145 2/414
5,974,593 A * 11/1999 McNabb ..... A42B 3/145 2/414
5,996,126 A * 12/1999 Barthold ..... A42B 3/14 2/410
6,128,786 A * 10/2000 Maddux ..... A42B 3/145 2/418
6,378,140 B1 * 4/2002 Abraham ..... A42B 3/064 2/411
6,865,752 B2 * 3/2005 Udelhofen ..... A42B 3/324 2/418
7,059,329 B2 6/2006 Mason et al.
7,089,602 B2 * 8/2006 Talluri ..... 2/411
7,607,179 B2 * 10/2009 Shih ..... A42B 3/20 2/411
7,770,239 B1 * 8/2010 Goldman ..... A42B 3/142 2/415
8,850,622 B2 * 10/2014 Finiel et al. ..... 2/410
8,955,169 B2 * 2/2015 Weber ..... A42B 3/125 2/410
9,314,062 B2 * 4/2016 Marz ..... A42B 3/12
2002/0004947 A1 * 1/2002 Bacchiega ..... A41D 31/0061 2/412
2003/0070209 A1 * 4/2003 Falone ..... A41D 13/015 2/412
2004/0025229 A1 * 2/2004 Takahashi ..... A42B 3/128 2/412
2004/0261157 A1 * 12/2004 Talluri ..... A42B 3/063 2/412
2005/0246824 A1 * 11/2005 Berger ..... A42B 3/124 2/412
2007/0000032 A1 * 1/2007 Morgan ..... A42B 3/124 2/412
2007/0190293 A1 * 8/2007 Ferrara ..... B29C 45/0053 428/166
2008/0155735 A1 * 7/2008 Ferrara ..... A01N 25/18 2/412
2008/0163410 A1 * 7/2008 Udelhofen ..... A42B 3/20 2/413
2009/0158506 A1 * 6/2009 Thompson ..... A42B 3/127 2/411
2010/0186150 A1 * 7/2010 Ferrara ..... A42B 3/128 2/412
2012/0017358 A1 1/2012 Princip et al.
2013/0061371 A1 * 3/2013 Phipps ..... A42B 3/064 2/411
2013/0185837 A1 * 7/2013 Phipps ..... A42B 3/12 2/2.5
2013/0212783 A1 * 8/2013 Bonin ..... A41D 13/065 2/411

(56) References Cited

U.S. PATENT DOCUMENTS

| | | | | |
|---|---|---|---|---|
| 2013/0232668 | A1* | 9/2013 | Suddaby | A42B 3/064 2/413 |
| 2014/0173810 | A1* | 6/2014 | Suddaby | A42B 3/124 2/413 |
| 2014/0208486 | A1* | 7/2014 | Krueger | A42B 3/064 2/414 |
| 2014/0223641 | A1* | 8/2014 | Henderson | A42B 3/065 2/411 |
| 2014/0223644 | A1* | 8/2014 | Bologna | A42B 3/20 2/414 |

FOREIGN PATENT DOCUMENTS

| | | | | |
|---|---|---|---|---|
| EP | 623292 | A1 * | 11/1994 | A42B 3/10 |
| GB | 2513598 | A1 * | 5/2014 | A42B 3/06 |
| JP | 57077307 | A | 5/1982 | |
| JP | 58109412 | | 2/1985 | |
| JP | 60010962 | | 8/1985 | |
| JP | 38007970 | | 2/1986 | |
| JP | 34006108 | A | 1/1989 | |
| JP | 08506747 | A | 7/1996 | |
| JP | 10507493 | A | 7/1998 | |
| JP | 200616740 | A | 1/2006 | |
| WO | 199843560 | A1 | 10/1998 | |
| WO | 199049745 | | 10/1999 | |
| WO | 2007052015 | A2 | 5/2007 | |

OTHER PUBLICATIONS

European Search Report dated Apr. 6, 2016 from corresponding European application No. 13748801.1.

* cited by examiner

PERSONAL IMPACT PROTECTION DEVICE

CROSS-REFERENCE TO RELATED APPLICATION

This application claims priority of Provisional Application Ser. No. 61/599,566, filed on Feb. 16, 2012.

FIELD

This disclosure relates to an impact protection device that is worn on the person.

BACKGROUND

Helmets, shoulder pads, thigh pads and other protective gear is used by people in various situations to help protect the body from injury due to impacts. In contact sports such as football, hockey and lacrosse, impacts to the head can be especially problematic.

Protective gear typically aims to absorb impact energy through the use of compressive pads. Such pads do absorb some energy, but are not sufficient. One problem is that when pads reach their compression limit they lose effectiveness. Another problem is that only the portion of the pad directly under the impact location, and areas close to the impact location, is compressed, which limits the pad volume involved in energy absorption and thus limits its effectiveness.

SUMMARY

This disclosure features a personal impact protection device comprising a first mechanical member, a second mechanical member spaced from the first mechanical member, and one or more elastomeric energy-absorption members mechanically coupled to and spanning the distance between both of the mechanical members. The mechanical members may be nested and may be generally concentric. The first mechanical member may comprise a first shell that is constructed and arranged to be placed on the head, and the second mechanical member may comprise a second shell that substantially surrounds and is spaced from the first shell. The impact protection device may further comprise a face-mask that is mechanically coupled to the second shell. The energy-absorption members may be thin, flat sheet members or elongated straps. The impact protection device may be, for example, a helmet, a knee protector or a thigh protector.

The impact protection device may further comprise one or more energy absorption subassemblies. The energy absorption subassemblies may comprise generally concentric spaced rings comprising an inner ring and an outer ring, and a plurality of the energy-absorption members mechanically coupled to both the inner ring and the outer ring and spanning the distance between the rings. The energy-absorption members that are coupled to the spaced rings may be generally annular. The energy-absorption members that are coupled to the spaced rings may themselves be spaced around at least most of the circumferences of the inner and outer rings. The inner ring may be fixed to the outside of the first mechanical member, and the outer ring may be fixed to the inside of the second mechanical member. The energy-absorption members may be elastomeric strips that are coupled together at one end and free from each other at the other end. Some of the energy-absorption members may be longer than other members. Some of the energy-absorption members may be stronger than other members.

The first mechanical member may comprise a first inner ring and the second mechanical member may comprise a first outer ring spaced from and surrounding the first inner ring; a plurality of the energy-absorption members may be mechanically coupled to both the first inner ring and the first outer ring and span the distance between such rings. The impact protection device may further comprise a first shell to which the first outer ring is mechanically coupled. The impact protection may further comprise a second inner ring and a second outer ring spaced from and surrounding the second inner ring, and a plurality of energy-absorption members mechanically coupled to both the second inner ring and the second outer ring and spanning the distance between such rings. The impact protection device may further comprise a second shell to which the second outer ring is mechanically coupled. The first shell and the second shell may be connected by a hinge that is located between the shells. The first shell and the second shell may each be constructed and arranged to be attached to clothing covering a leg, with one shell above the knee and the other shell below the knee and the hinge proximate the knee.

Also featured in this disclosure is a helmet comprising a first shell that is constructed and arranged to be placed on the head, a second shell that substantially surrounds and is spaced from the first shell, one or more energy absorption subassemblies located between the first and second shells, each energy absorption subassembly comprising generally concentric spaced rings comprising an inner ring and an outer ring and a plurality of elastomeric energy-absorption members mechanically coupled to both the inner ring and the outer ring and spanning the distance between the rings; the energy-absorption members are spaced around at least most of the circumferences of the inner and outer rings. The inner ring of each energy absorption subassembly is fixed to the outside of the first shell, and the outer ring of each energy absorption subassembly is fixed to the inside of the second shell.

Further featured herein is an impact protection device for protection of a knee comprising two energy absorption subassemblies, each energy absorption subassembly comprising generally concentric spaced rings comprising an inner ring and an outer ring, and a plurality of elastomeric energy-absorption members mechanically coupled to both the inner ring and the outer ring and spanning the distance between the rings; the energy-absorption members are spaced around at least most of the circumferences of the inner and outer rings. There is a first housing to which the outer ring of a first energy absorption subassembly is mechanically coupled, and a second housing to which the outer ring of the second energy absorption subassembly is mechanically coupled. The first housing and the second housing are each constructed and adapted to be attached to clothing covering a leg, with one housing above the knee and the other housing below the knee. The first housing and the second housing are connected by a hinge that is located between the housings and proximate the knee.

DESCRIPTION OF EMBODIMENTS

The advance set forth in this disclosure may be accomplished in a personal impact protection device. The personal impact protection device uses one or more elastomeric energy-absorption members that are mechanically coupled to two spaced nested mechanical members that act as impact areas, and also act as anchor points and supports for the elastomeric members. One of the two mechanical members is coupled to a person's body. The coupling can be to clothing worn by the person or directly to the body of the person. The coupling can be accomplished by means such as elastic straps. When the impact protection device undergoes impact to the second or outer member, the second mechanical member (that is not coupled to the body) is moved relative to the first mechanical member. This movement causes the spacing between the members to change: on the side of the members away from the impact, the spacing between the members increases. This causes the elastomeric members located in the region in which the spacing has increased to stretch. As the elastomeric members stretch, they absorb momentum and thus lower the force felt by the person wearing the device. The impact protection device thus helps to protect the person from injury caused by the impact.

Figure 1A:
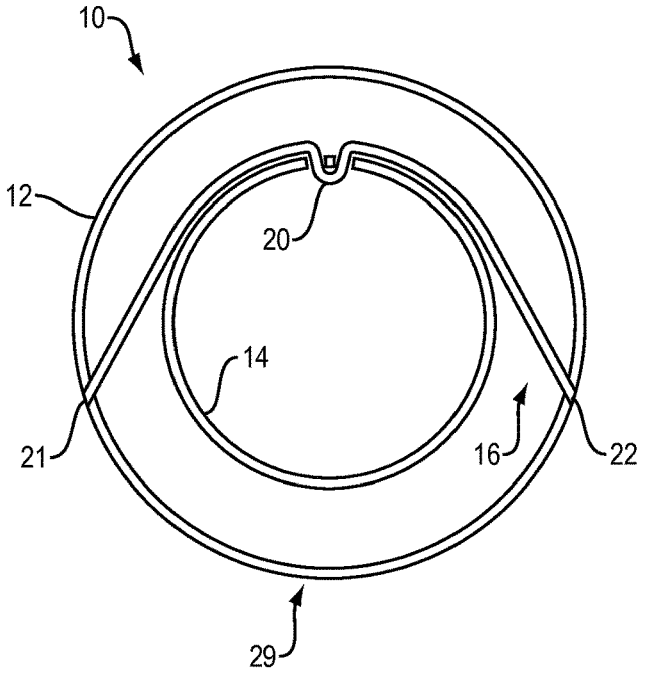
FIG. 1A is a highly schematic cross-sectional representation of a personal impact protection device in the at-rest position.
Figure 1B:
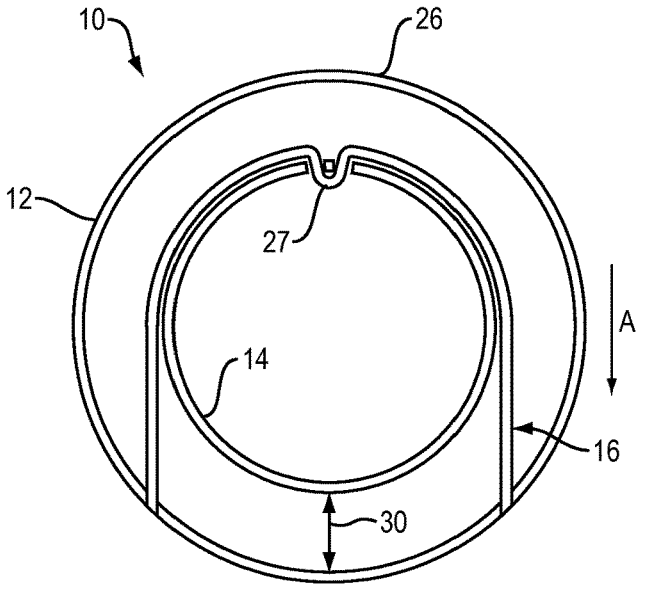
FIG. 1B is a view of the same device under impact.

Personal impact protection device 10 is schematically depicted in FIGS. 1A and 1B. Device 10 includes outer mechanical member or shell 12 that substantially or fully surrounds, and is spaced from, inner mechanical member or shell 14. The shells are preferably nested together and they may or may not be concentric. Shells 12 and 14 are sized and shaped and made from a material that is sufficient for the intended application of device 10. Different applications are described below. Typically, shells 12 and 14 are made from a molded plastic material such as polycarbonate. Device 10 includes one or more elastomeric energy absorption members. In this example, one member 16 provides the compliance and energy absorption functions. Member 16 in this case is a thin, flat piece of elastomeric material that may take the form of a strap or sheet of material. One material may be butyl rubber. Other materials, sizes, shapes and thicknesses are contemplated depending on the overall construction of the impact protection device, the arrangement of and distances between the first and second mechanical members, and the amount of force and the locations and directions of impact that are designed to be ameliorated by the device.

Energy-absorption member 16 is anchored to shell 12 at locations 21 and 22 and anchored to shell 14 at location 20. Upon inwardly-directed impact against shell 12 at or proximate location 26, shell 12 is pushed in the direction of arrow "A" relative to shell 14, which is stationary or largely stationary due to it being coupled to clothing or the body. The impact thus increases the distance between the shells at the side opposite the impact location, indicated by increased gap 30. This motion causes member 16 to stretch, which absorbs energy. In an ideal situation, all of the impact energy is absorbed by member 16. Even if less than all of the energy is absorbed, the energy absorption decreases the amount of energy transferred to the body in and around area 27 proximate the area of impact 26.

Figure 2:
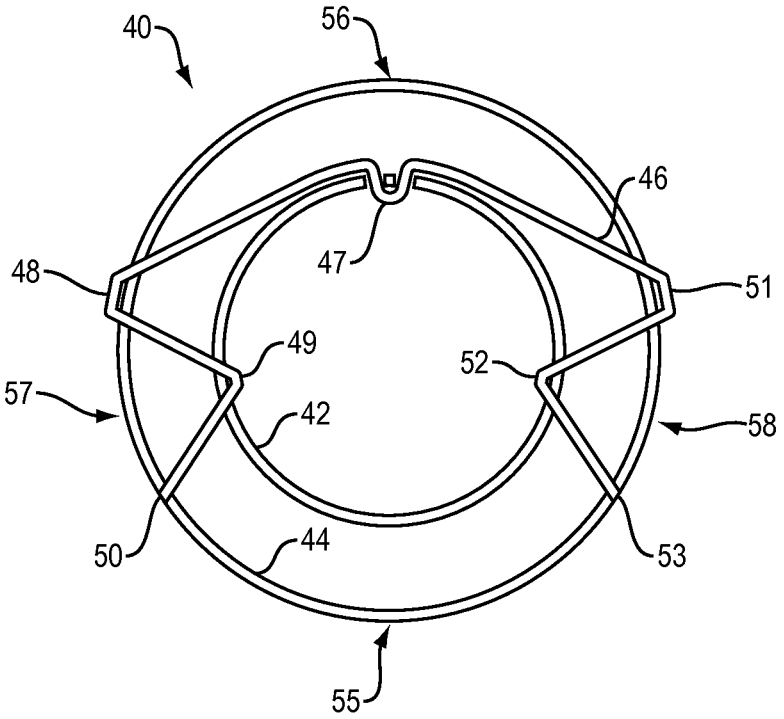
FIG. 2 is a similar view of an alternative arrangement of a personal impact protection device.

The personal impact protection device can be constructed and arranged to absorb impact energy from all directions and angles, or from less than all. The example shown in FIGS. 1A and 1B would do little to absorb impact energy from direction 29 or another direction in which energy-absorption members are folded or compressed as opposed to being stretched, as the elastomeric energy-absorption members will simply bend or fold if they are compressed. This property of relatively thin and elongated elastomeric members can be ameliorated by arranging the one or more energy-absorption members such that they are stretched when the impact protection device is impacted in a particular location and/or direction. As one simple example, FIG. 2 depicts a personal impact protection device 40 that will absorb energy from impact around the entire circumference of outer member or shell 44. For impacts at the front area 56, rear area 55 and the lateral areas 57 and 58, elastomeric energy absorption member 46 will be stretched and thus absorb energy. This is accomplished by anchoring single elastomeric member 46 at points 47-53 to both the inner mechanical member or shell 42 and the outer mechanical member or shell 44. The same function could be accomplished with a plurality of elastomeric energy-absorption members that are mechanically coupled to both the inner and outer shells and located at locations in which the outer shell will be pushed away from the inner shell upon impact: in other words, in locations other than at the impact or expected impact location. Obviously if impact can be expected at any point around the circumference of the impact protection device, elastomeric energy-absorption members should be spaced around at least most of or all of the circumferences of the inner and outer shells. Other energy absorption means such as traditional compressible cushioning (not shown), can potentially be added, to augment the elastomeric-based energy absorption by locating the cushioning between the energy absorption members at the expected impact areas.

The personal impact protection device may include one or more energy-absorption subassemblies. Broadly, an energy-absorption subassembly can be an assembly that carries one or more elastomeric energy-absorption members and that is constructed and arranged to be mechanically coupled to and located between the first and second mechanical members or shells. The energy-absorption subassemblies thus can assist with the ease of manufacturing or assembly of the personal impact protection device.

Figure 3A:
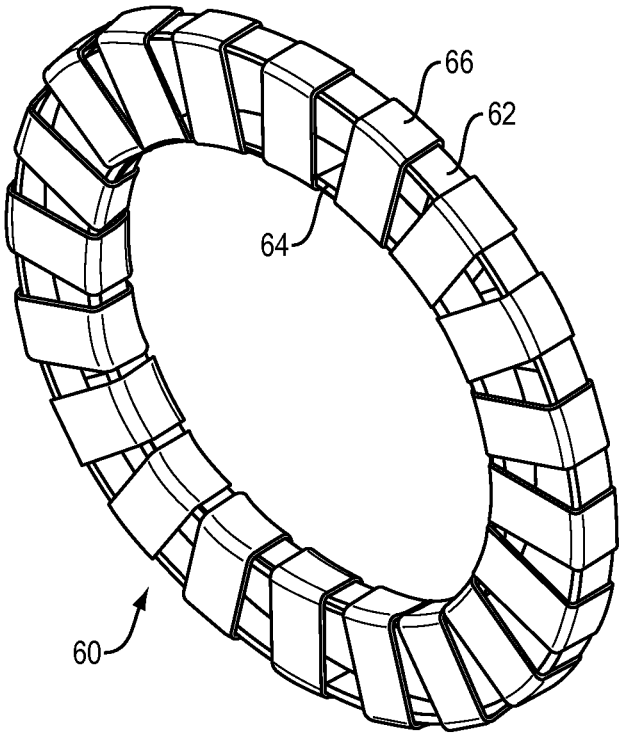
FIGS. 3A and 3B are perspective and top views, respectively, of an energy-absorption subassembly for a personal impact protection device.
Figure 3C:
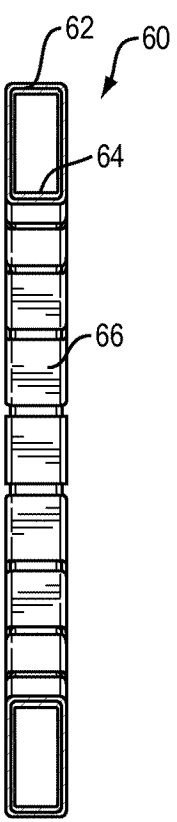
FIG. 3C is a cross-sectional view taken along line A-A of FIG. 3B.
Figure 3B:
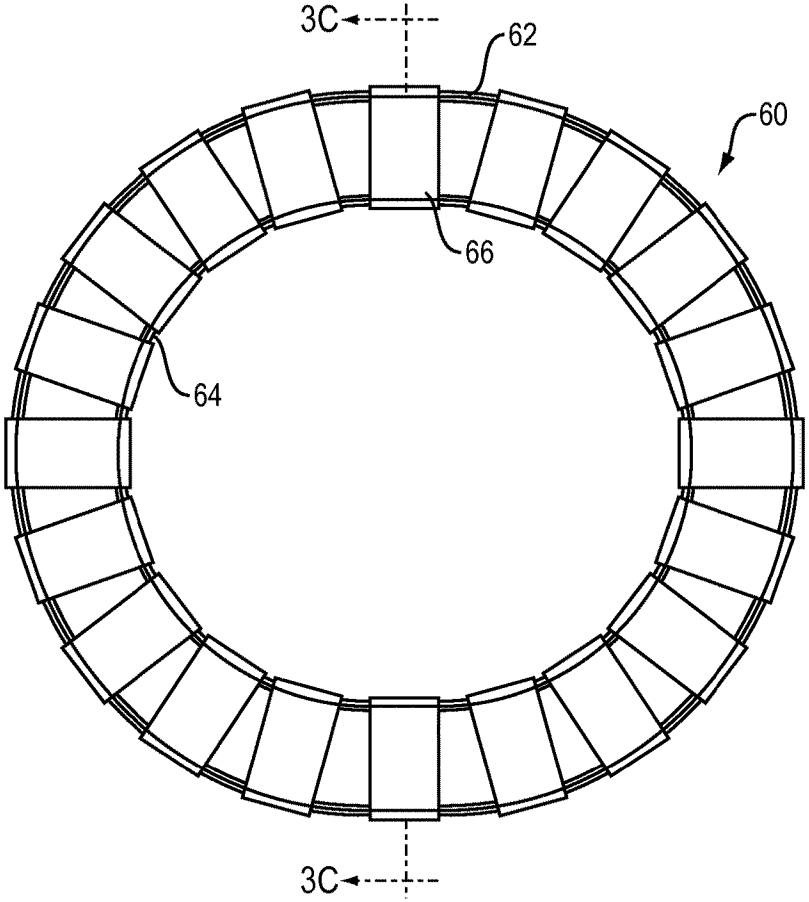

In a non-limiting embodiment shown in FIGS. 3A-3C, energy-absorption subassembly 60 comprises generally concentric spaced annular rings comprising an inner ring 64 and an outer ring 62. A plurality of energy-absorption members 66 are mechanically coupled to both the inner and outer ring and span the distance between the rings. In this example, members 66 are annular pieces of elastomeric material. Members 66 can be created, for example, through extrusion, or by cutting an elastomeric tube of the correct diameter into pieces of a desired width. Members 66 can be anchored to the rings or not, can be a desired thickness and width and/or material, and can be located at desired locations and spaced in a desired manner to accomplish a particular amount of energy-absorption at one or more desired locations of the subassembly. For example, stronger elastomers can be placed with some slack such that they begin to stretch only close to the endpoint of travel of the outer ring (or the outer mechanical assembly); this would be useful for heavy impacts that otherwise would cause the rings (or mechanical members) to come into contact and thus prevent further energy absorption. Multiple elastomeric members of different lengths and/or different strengths can be located in parallel so that their energy-absorption is cumulative.

The subassembly can be mechanically coupled to the mechanical members/shells in a desired fashion, such as by riveting or using other fasteners. Typically, outer ring 62 would be fixed into the inside of the outer shell, and inner ring 64 would be fixed to the outside of the inner shell. Subassembly 60 thus would establish the gap between the inner and outer mechanical members/shells.

The circular subassembly is not necessary. A similar result can be accomplished by using a number of smaller subassemblies each comprising spaced structural members that are adapted to support one or more elastomers, e.g., with one or two elastomers to each subassembly. The subassemblies can be arc-shaped, or can take another shape that is appropriate for the space between shells in which they are to be located. They can be distributed anywhere in the helmet or other personal impact protection device. They can be attached to any helmet of any size using standard mechanical fasteners such as rivets. The elastomer is tubular, like a piece of a bicycle inner tube. The tubes slip over the structural members of the subassembly, and the subassemblies are then attached to each shell. The absorption strength of a subassembly can be changed simply by using a longer tube. The distance between the shells can be any length, say from 1 to 3 inches, using standard parts. A three inch elastomer has nine times the absorption of a 1 one inch elastomer. More generally, subassembly 60 can be divided into individual subassemblies as may be desirable to achieve a particular result.

Figure 4:
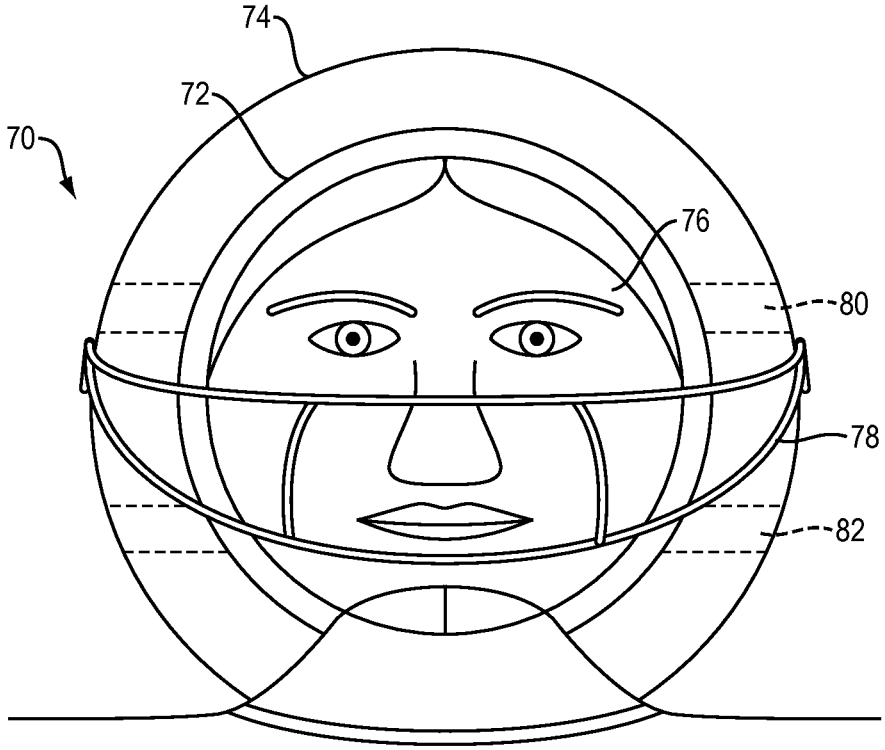
FIG. 4 is a highly schematic representation of a helmet worn on the head to protect the head.

One particular embodiment of the personal impact protection device is a helmet that is constructed and arranged to be worn on the head of a user to protect the head from impact injury. Helmet 70, FIGS. 4 and 5, comprises first or inner shell 72 that is constructed and adapted to be placed on head 76. This placement anchors shell 72, ideally such that it does not move, or at least is constrained from movement in six degrees of freedom. Outer shell 74 is spaced from and substantially surrounds inner shell 72. In this example, two energy-absorption subassemblies 80 and 82 are located in the space between shells 72 and 74. Subassemblies 80 and 82 generally have the same construction as subassembly 60, FIG. 3. If subassembly 80 is located in the helmet around the forehead region, where the helmet encircles the head, it can be fully annular and can have elastomeric energy-absorption members around its entire periphery. Since second subassembly 82 is located in a region of the helmet that has an opening in front of the face, it is not fully annular but is more arc-shaped, encompassing an angle of around 180 to 270 degrees. Face mask 78 is mechanically coupled to outer shell 74, so that forces on the facemask are transferred to the outer shell and thus cause its motion, which results in forces being dispersed.

Figure 5A:
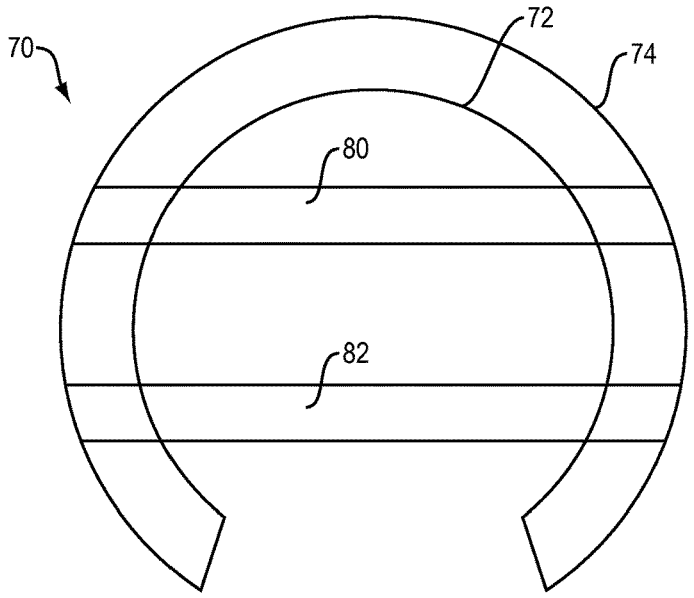
FIGS. 5A and 5B are schematic side views of the helmet of FIG. 4 in the at-rest and under-impact positions, respectively.
Figure 5B:
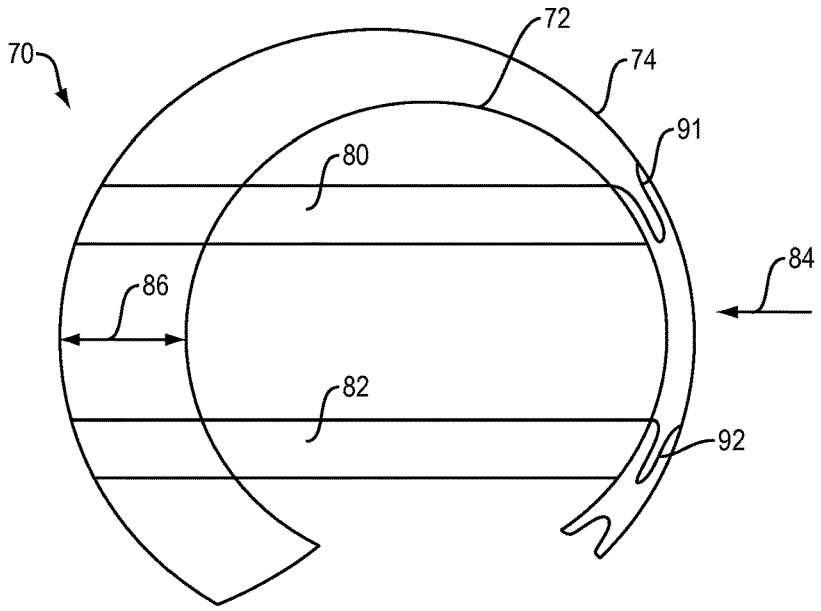
Figure 6A:
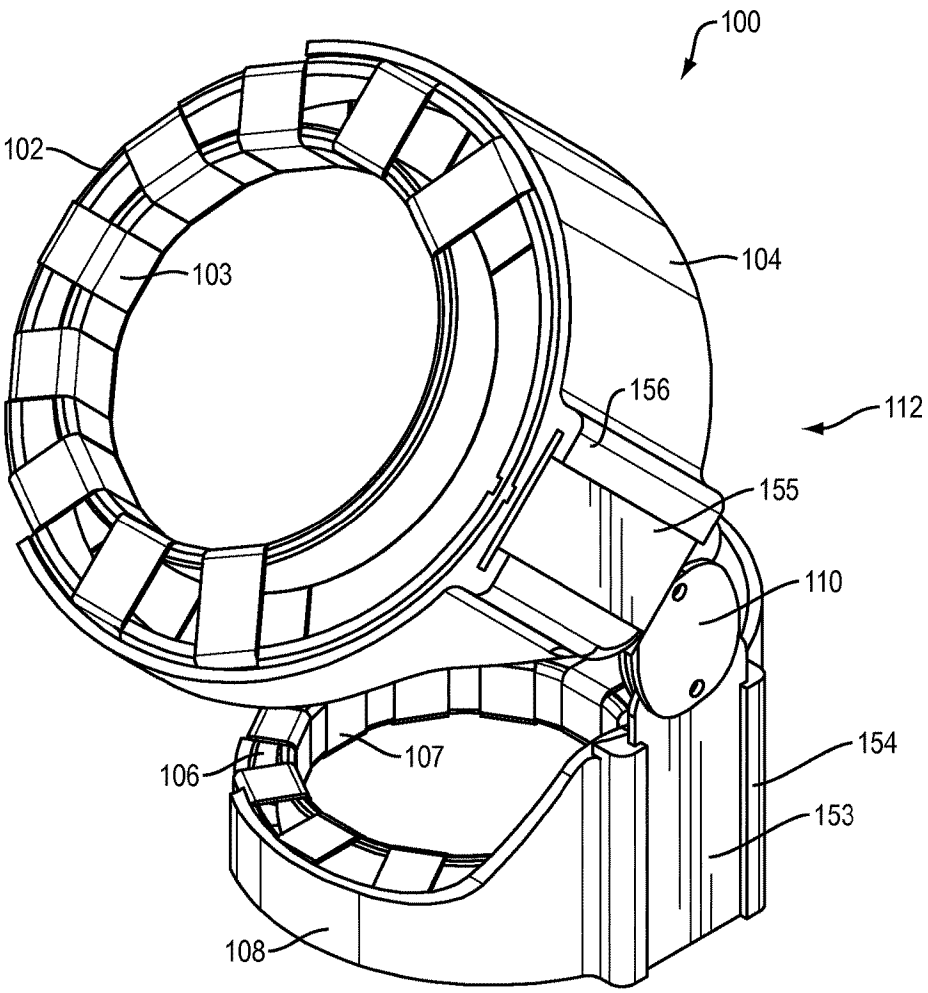
FIGS. 6A, 6B, 6C and 6D are perspective, side, front, and a second perspective view, respectively, of an impact protection device for protection of a knee.
Figure 6C:
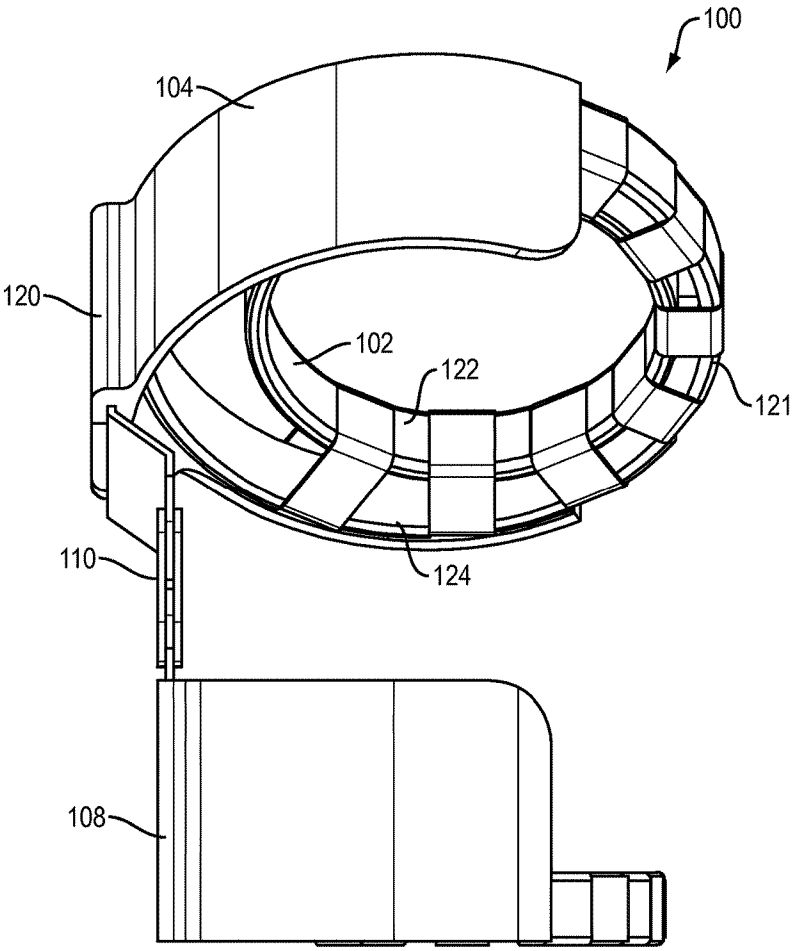
Figure 6B:
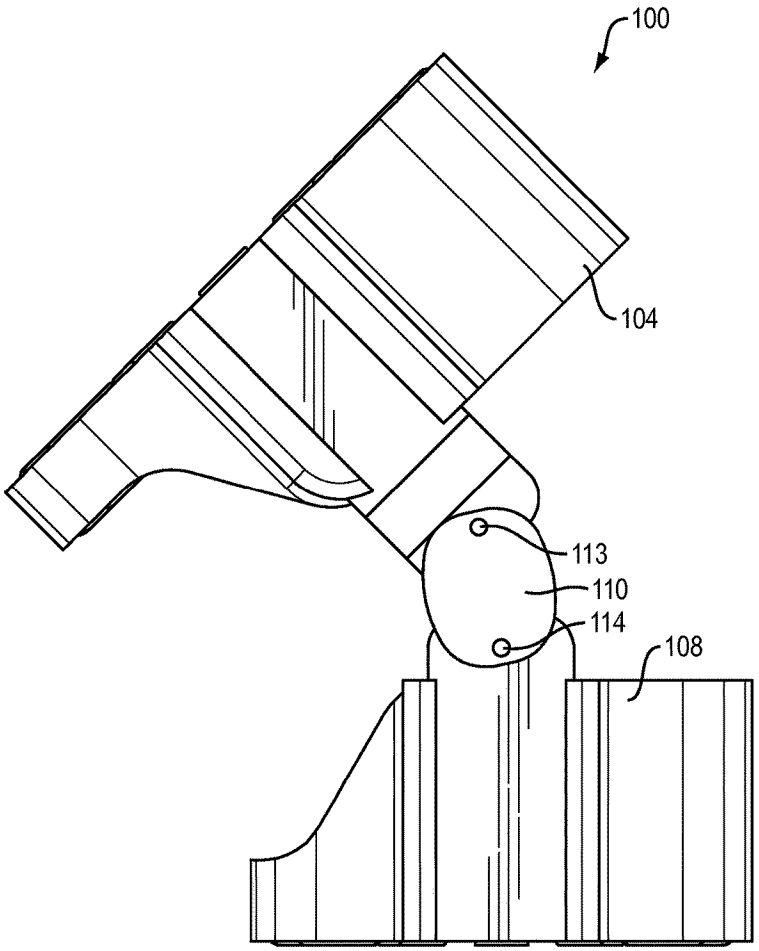
Figure 6D:
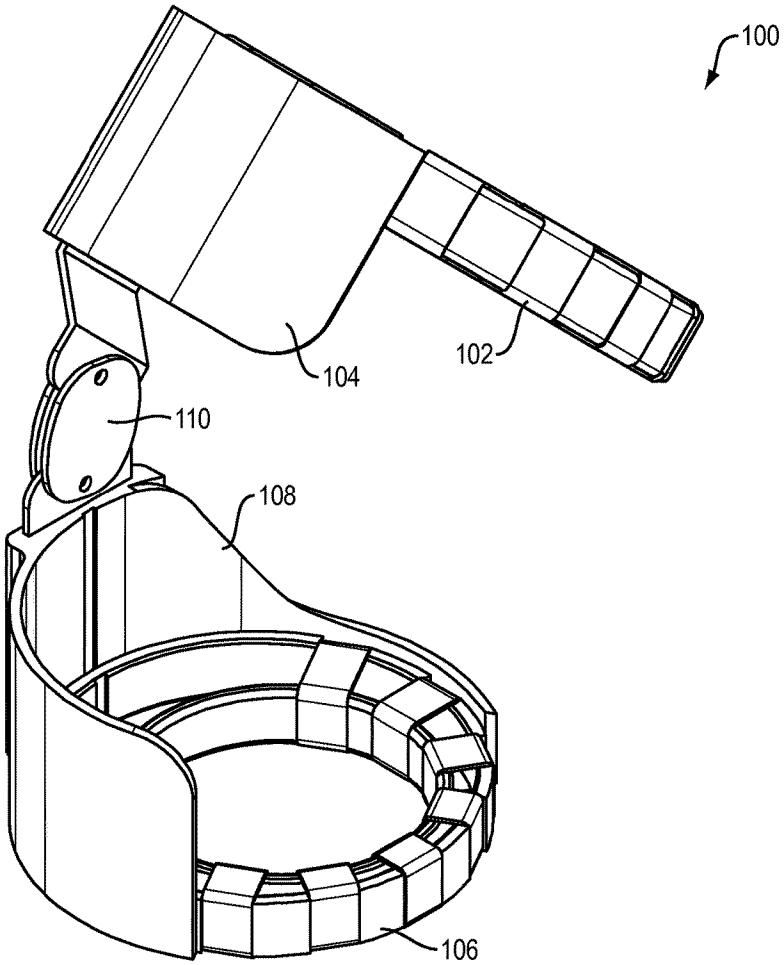

The operation of helmet 70 is schematically depicted in FIGS. 5A and 5B. FIG. 5A shows a rest position in which there is no impact on the helmet. FIG. 5B shows an impact 84 on the left side of helmet 70. The impact pushes shell 74 to the left, in other words, parallel to the direction of the impact. Since shell 72 is fixed to the head, it does not substantially move. The result is that gap 86 is increased, which stretches all of the elastomeric members of both subassemblies 80 and 82 that are on the right-hand side of the subassemblies, and to some extent, elastomeric members located at the front and rear of the helmet. This absorbs impact energy. Elastomeric members in the area of impact are folded or compressed as indicated by members 91 and 92; these contribute little or nothing to energy absorption.

Helmet 70 is also able to absorb blows borne from the bottom or top, and oblique blows that cause torque. Any impact that moves the outer ring of an energy-absorption subassembly relative to the inner ring will cause one or more elastomeric members to stretch, and thus absorb energy. Any motion of the outer shell that causes the stretching in any direction of one or more elastomeric members will absorb energy and thus help to ameliorate the effects of impact.

Figure 7:
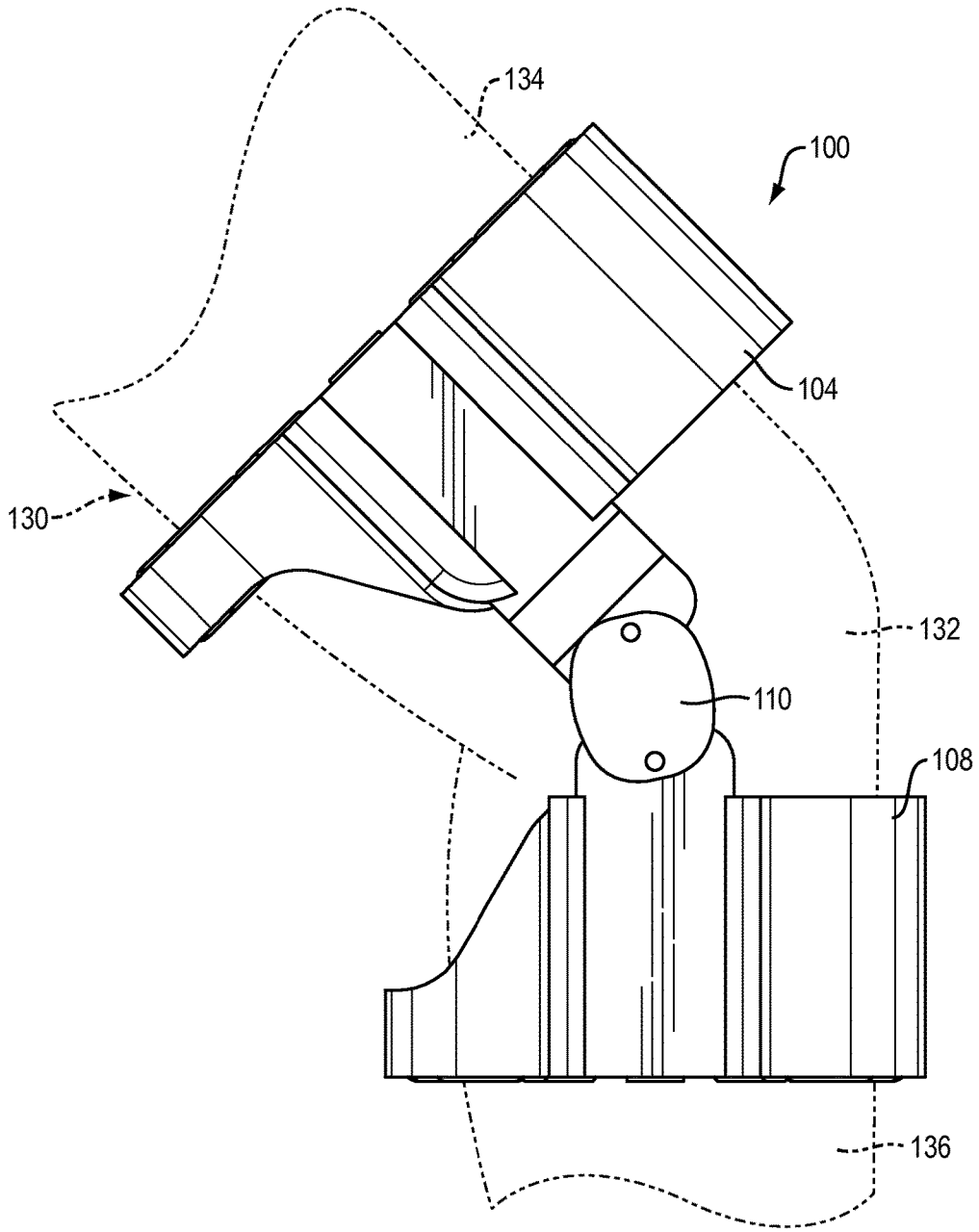
FIG. 7 shows the device of FIG. 6 in use.

A specific embodiment of an impact protection device for protection of a knee, is shown in FIGS. 6 and 7. Device 100 in this case comprises two energy absorption subassemblies 102 and 106. Each such subassembly is mechanically coupled to one of housings 104 and 108. The housings are interconnected by a pivot or hinge device 110 that allows housings 104 and 108 to pivot about one or more axes that are normal to the surface of hinge 110. Also, plates 153 and 155 that are directly coupled to hinge 100 are adapted to slide up and down within receiving channels 154 and 156, respectively, to give housings 104 and 108 the ability to move vertically; this allows for adjustment for comfort and fit, and also allows for greater freedom of movement of the user. In use as shown in FIG. 7, pivot 110 is placed proximate knee area 132 of leg 130. Hinge 100 could be covered by a protective cover or disk (not shown) to help prevent it from being damaged by impacts. Housing 104 is located above the knee, in thigh area 134. Housing 108 is located below the knee, in calf area 136. Device 100 is designed to help absorb the energy of impacts to the outside of the knee.

Device 100 is worn such that the side with the pivot and that defines a continuous portion of hinged housing assembly 112 is located along the outside as opposed to the inside of the wearer's knee, where impact is most likely to occur in a sport such as football. The housing assembly helps to transfer force at any location along the length of the assembly to one or both of the energy-absorption subassemblies 102 and 106. Assemblies 102 and 106 are arranged such that in the rest position shown in the drawings, there is a larger gap between the inner and outer rings on this outside area proximate portion 120 than on the opposite or inside portion 121. Since the gap in the area of impact defines the maximum travel of the outer ring of the energy-absorption subassembly relative to the inner ring, having the inner and outer rings generally but not exactly concentric as in this case, can provide additional energy absorption in one direction, which in this case is impact to the outside of the knee area that can cause severe injury.

Housing 104 can pivot about axis 113. Housing 108 can pivot about axis 114. Structure 110 can pivot about axes 113 and 114. Elastomeric energy-absorption member 103 of subassembly 102 and elastomeric energy-absorption member 107 of energy absorption subassembly 106 are indicated in the drawings.

Figure 8A:
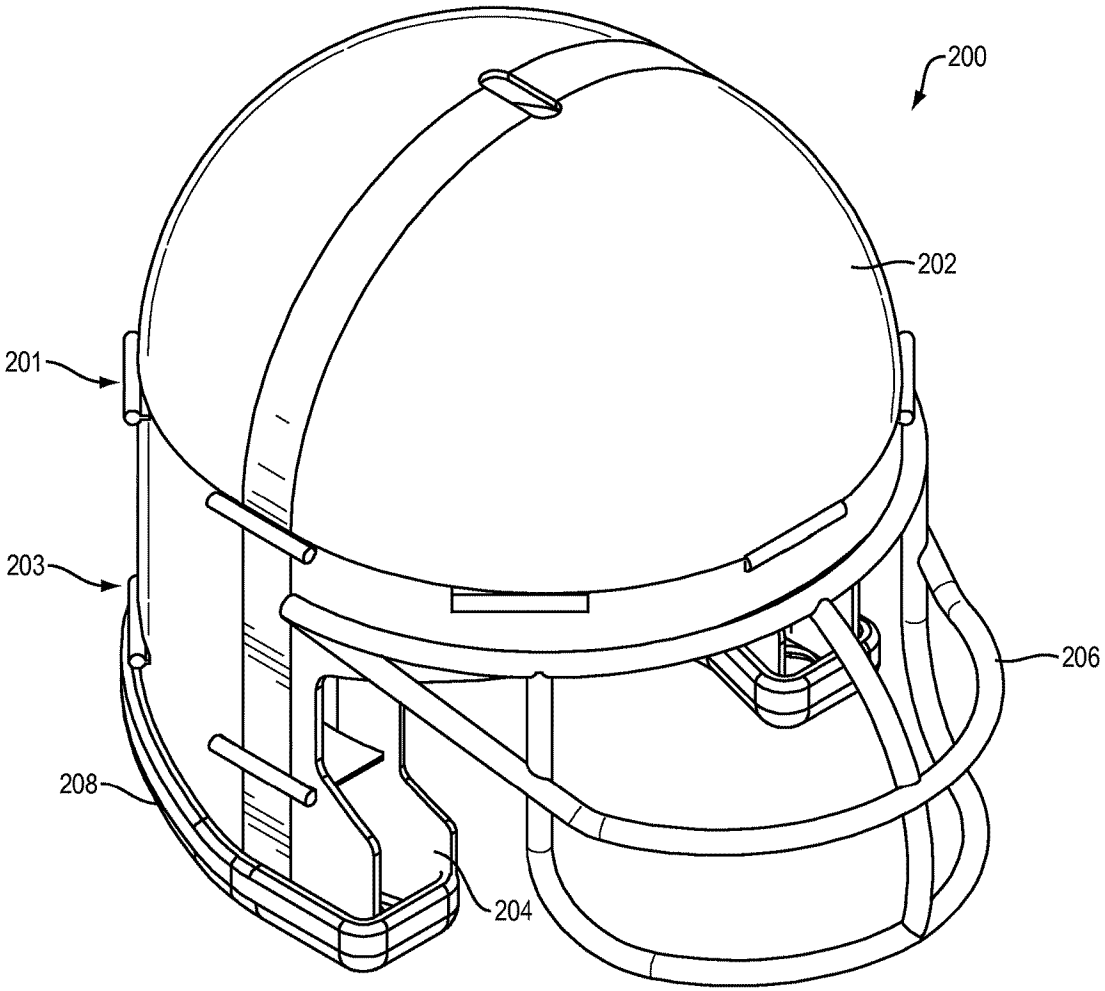
FIGS. 8A-8F are full perspective, hidden-detail perspective, side, top and two cross-sectional views, respectively, of a different helmet design.
Figure 8B:
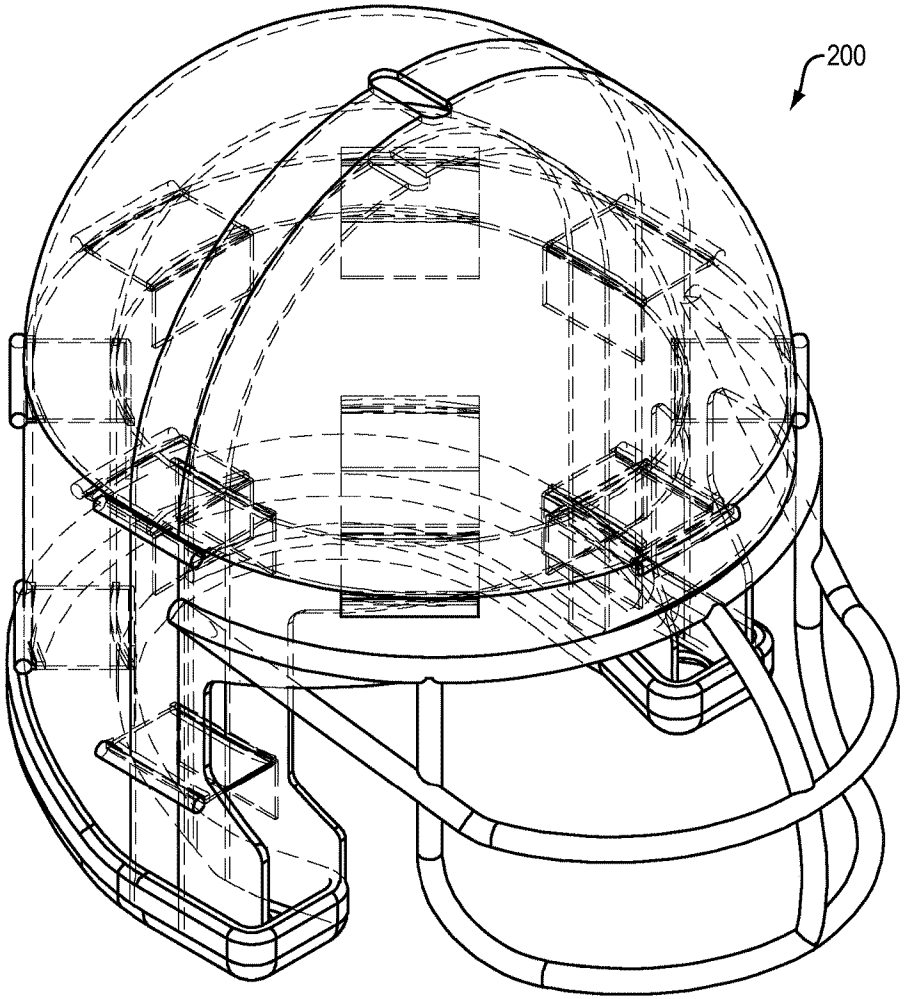
Figure 8C:
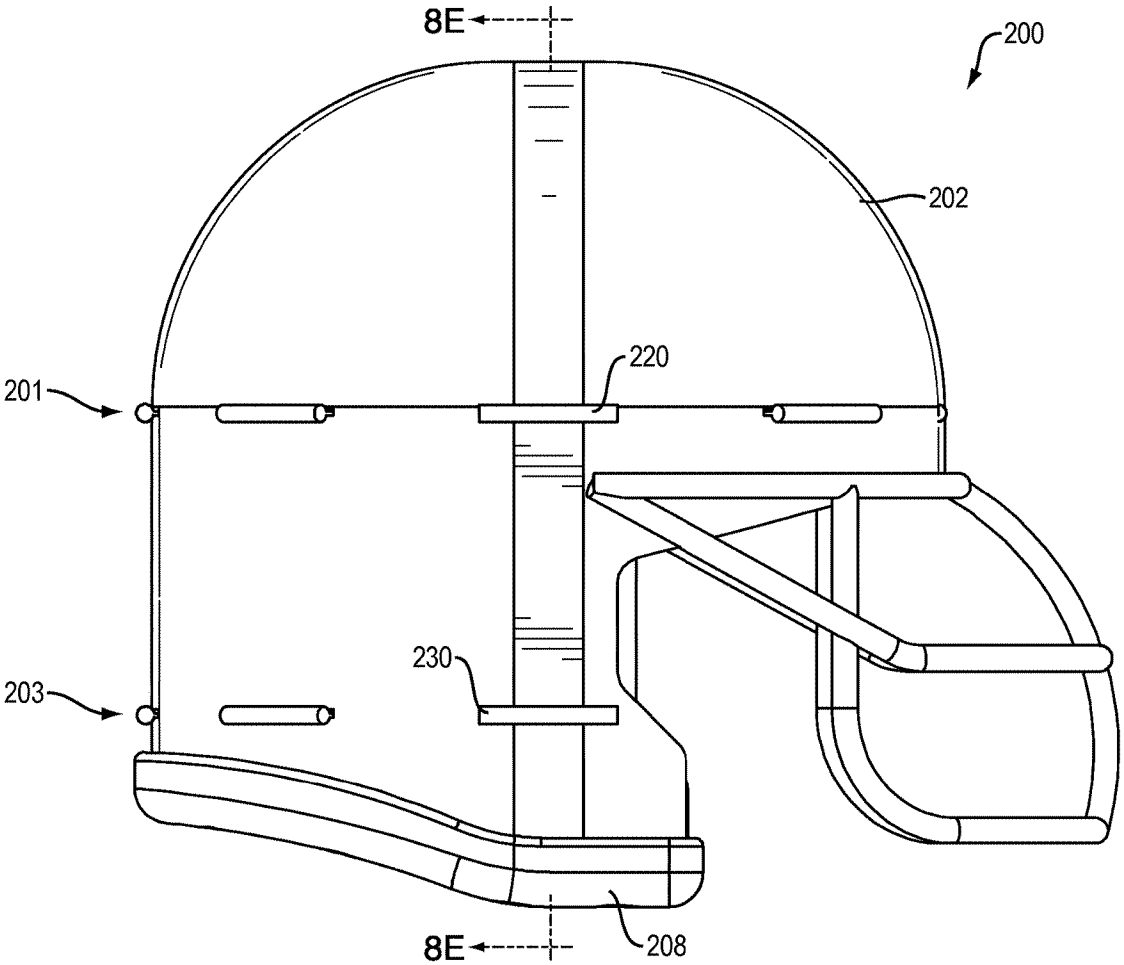
Figure 8D:
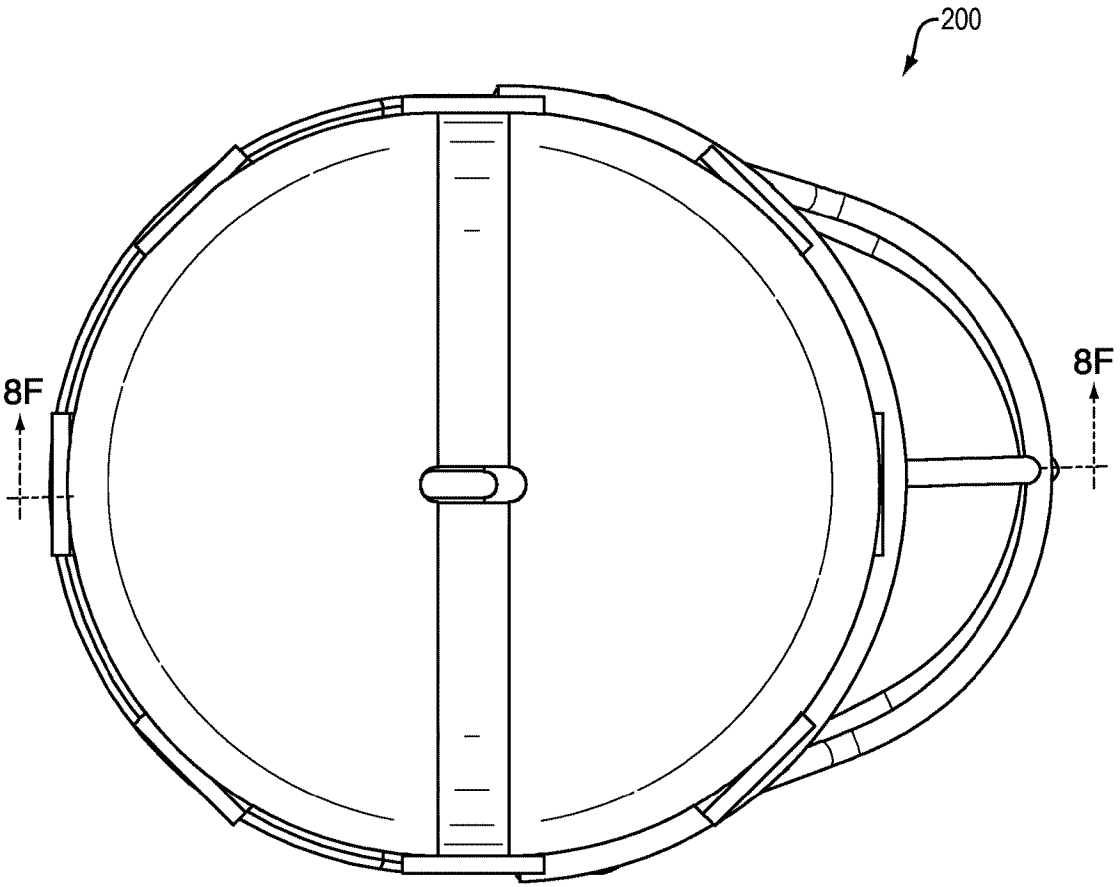
Figure 8E:
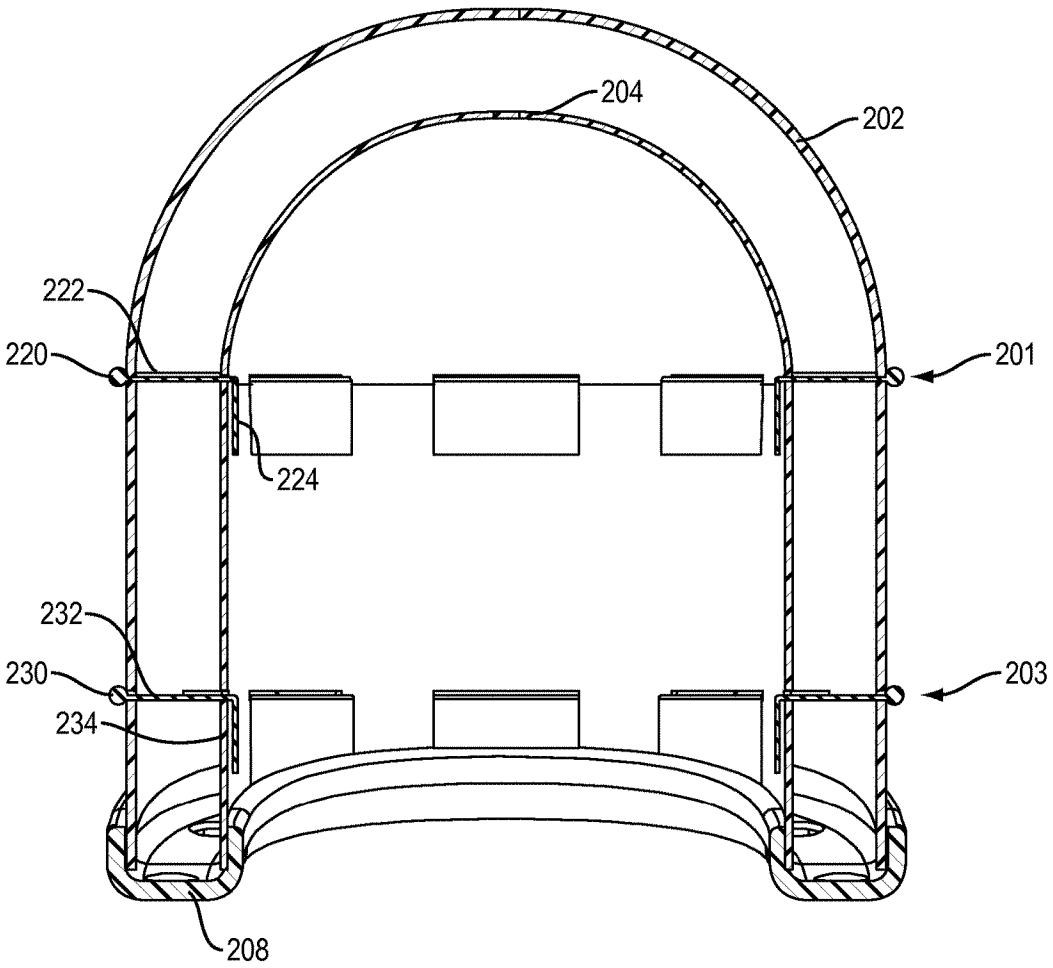
Figure 8F:
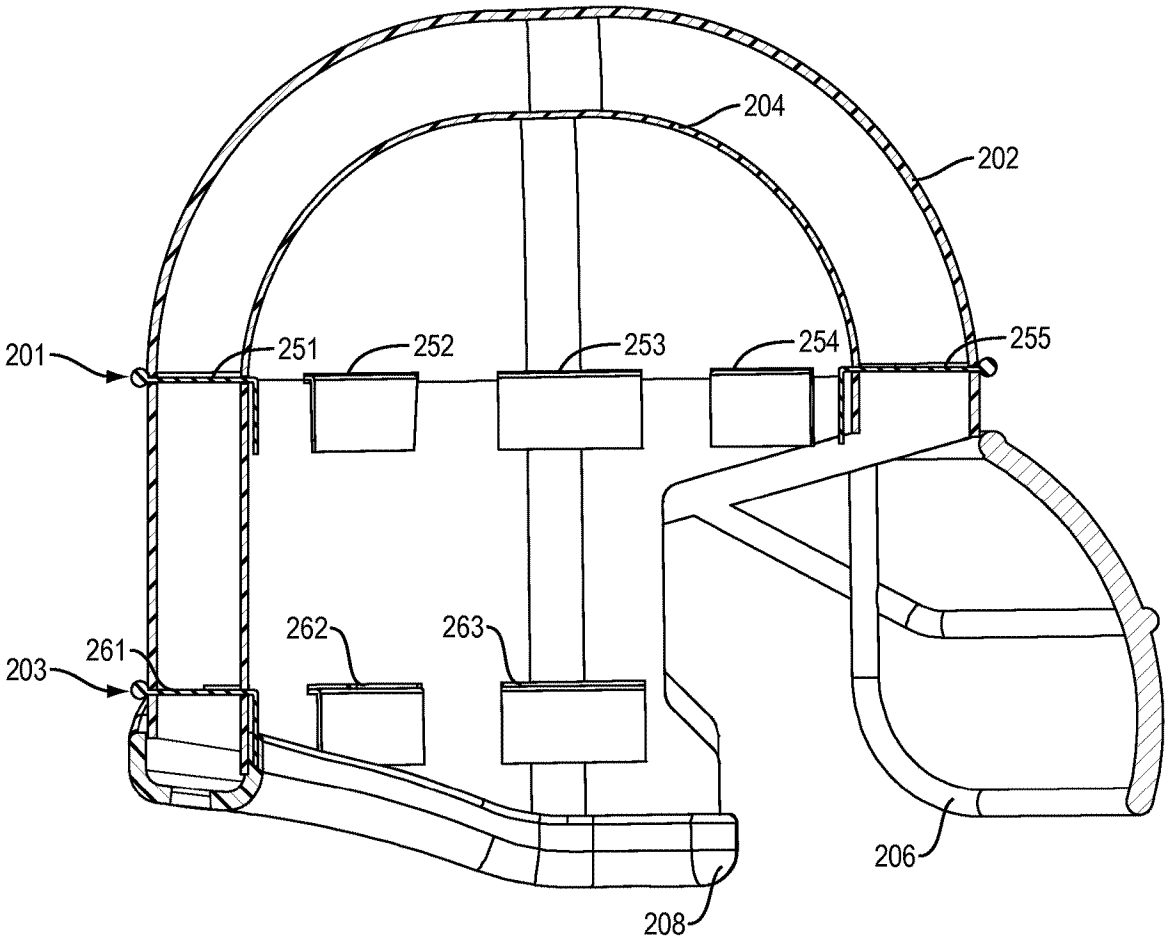
Figure 9:
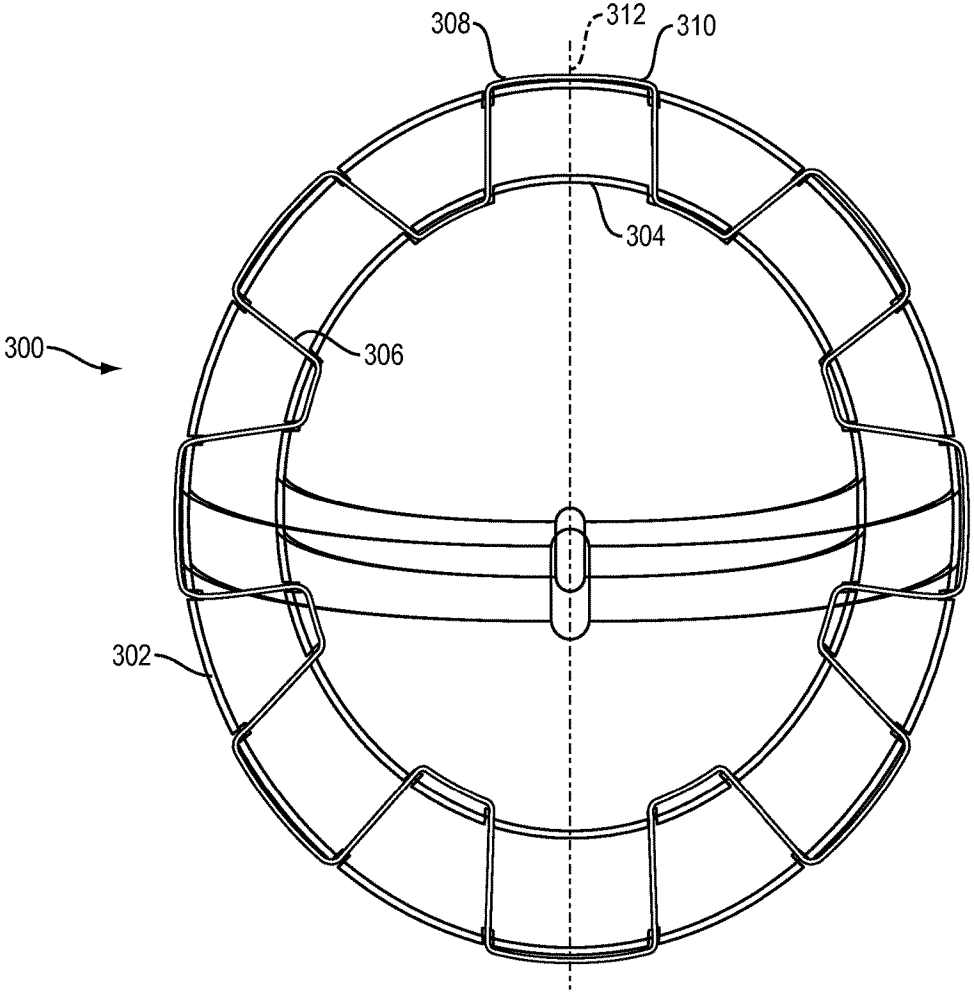
FIG. 9 is a schematic cross-sectional view of a different helmet design.

FIGS. 8A-8F show an alternative helmet design, and illustrates features that can be applied to helmets and other impact protection devices according to this disclosure. Helmet 200 comprises inner shell 204 that sits on the head and surrounding spaced outer shell 202. Facemask 206 is mounted to outer shell 202. Energy-absorption subassemblies 201 and 203 in this case each comprise a plurality of separate elastomeric members that are anchored in both shells, such as members 222 and 232, and as shown in FIG. 8F members 251-255 of subassembly 201, and members 261-263 of subassembly 203.

In this non-limiting example, each elastomeric member is a flat sheet that fits through slots in both shells. Each has one enlarged end (e.g., ends 220 and 230) that sits on either the outside of the outer shell or the inside of the inner shell to prevent the member from being pulled through the adjacent slot. The other ends of the elastomeric members are mechanically coupled to the other shell by a suitable mechanical means, such as clamps 224 and 234. Also, additional molded rubber or plastic part 208 (with sufficient compliance such that it does not substantially inhibit relative motion of the shells) is coupled to the lower rims of the two shells. Part 208 can potentially add some additional compliance/energy absorption, but mainly part 208 is used to close the opening between the shells to prevent clothing or other objects from entering.

Figure 11:
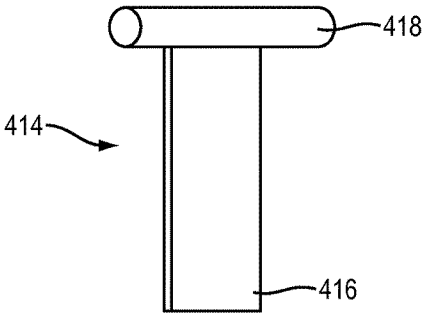
FIG. 11 shows a tool that can be used to insert the members shown in FIGS. 10A and 10B.
Figure 10B:
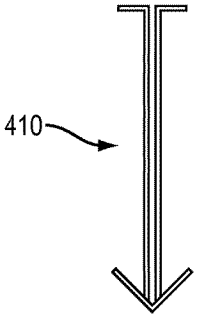
FIGS. 10A and 10B are side views of two alternative energy absorption members.
Figure 10A:
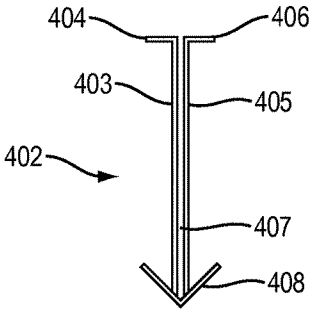
Figure 12:
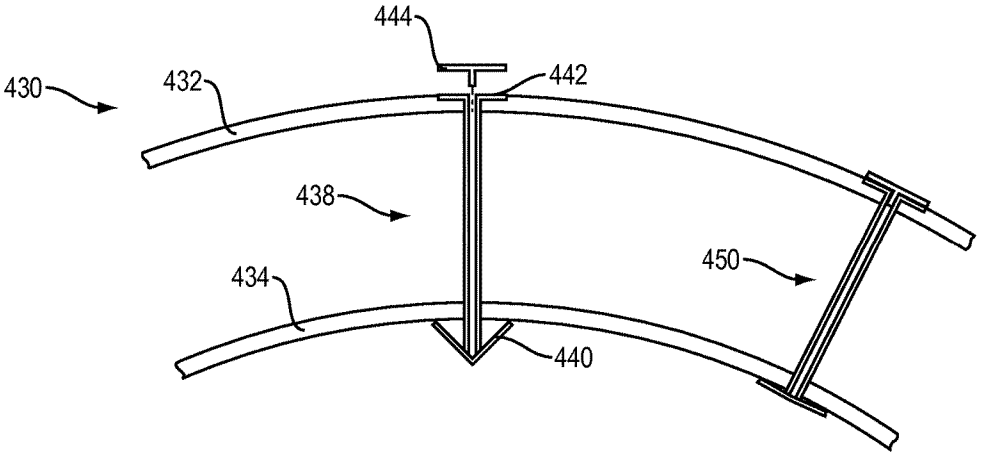
FIG. 12 is a partial cross sectional view of a protective device using the energy absorption members of FIGS. 10A and 10B.

FIGS. 10A and 10B show two similar energy absorption members 402 and 410. Differences between the two can be their length and/or their strength. Member 402 illustrates the construction with parallel legs 403 and 405 that have perpendicular terminal portions 404 and 406 and distal terminal portion 408. Members 402 and 410 can be coupled to two spaced shells such as shells 432 and 434 of impact protection device 430, FIG. 12. The members are pushed through aligned openings in the shells via tool 414, FIG. 11, which includes blade 416 that is sized and shaped to fit into opening 407 between legs 403 and 405. The handle 418 is pushed down to force enlarged end 408 through a hole in the inner shell. Upper ends 404 and 406 sit against the outer shell adjacent to the opening. This anchors the member to both shells. As shown in FIG. 12, enlarged common end 440 of member 438 will sit against the inside of inner shell 434 while end 442 sits in a recess on the outside of outer shell 432. Cap 444 can be pushed into the recess to smooth the outside of device 430. Member 450 is slightly longer than member 438 so it is slack in the at-rest, non-impacted position depicted in FIG. 12. Upon impact, member 438 will be stretched and then eventually if the shells are moved sufficiently far apart member 450 can be stretched to absorb more energy. Also, as described above, the different members can be different strengths (e.g., different thicknesses) to provide more variability to the energy absorption characteristics of the protective device.

Figure 13A:
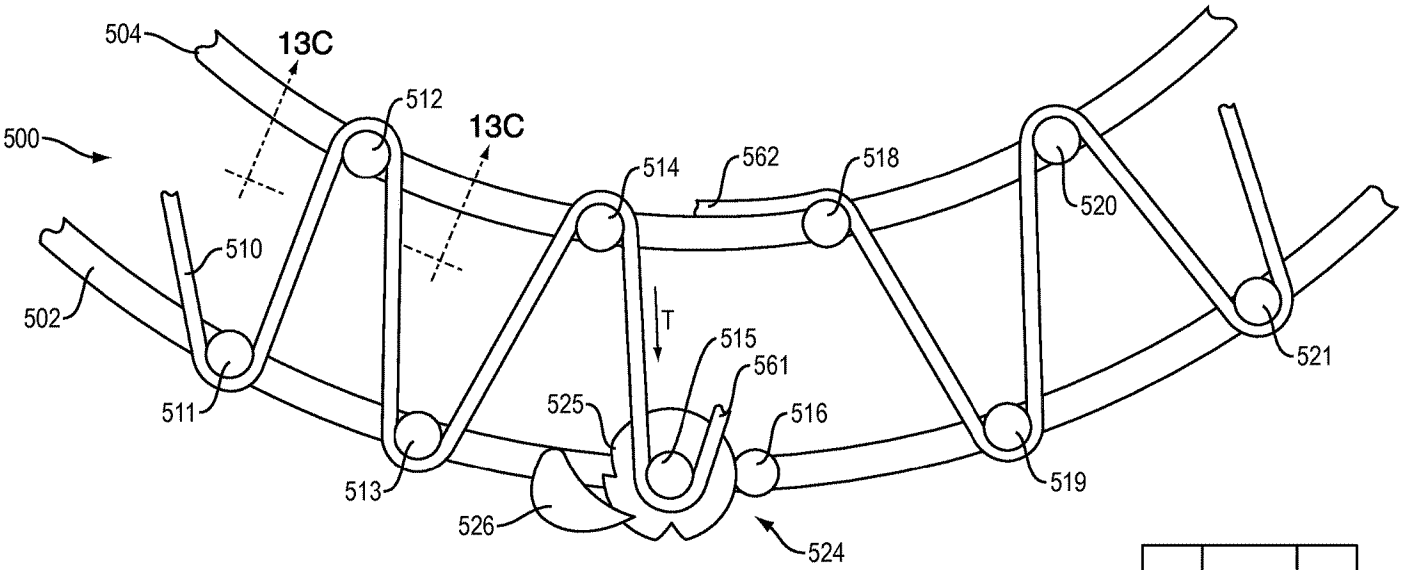
FIG. 13A is a partial cross-sectional view of another impact protection device.
Figure 13C:
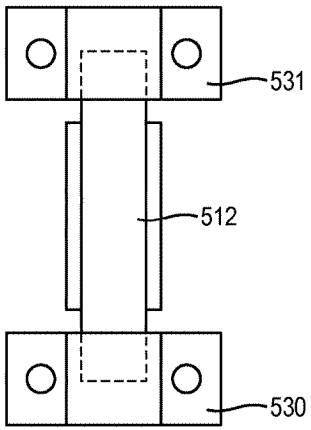
FIG. 13C is a cross-sectional view taken along line A-A of FIG. 13A.
Figure 13B:
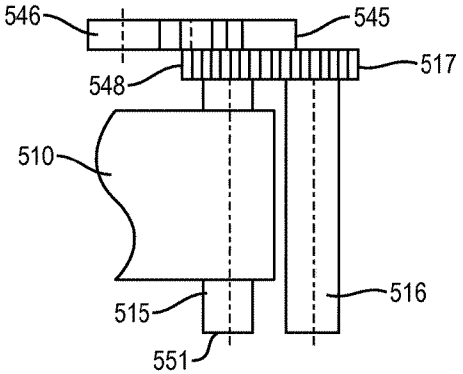
FIG. 13B is an end view of a portion of FIG. 13A.

Another example is shown in FIGS. 13A-13C. Impact protection device 500 includes outer shell 502 and inner shell 504. Elastomeric spring 510 connects the shells. Spring 510 is a continuous thin elastomeric sheet with ends 561 and 562. End 562 is fixed to shell 504 while end 561 is free. Spring 510 is threaded over rollers 511, 513, 515, 519 and 521 that are carried by outer shell 502, and rollers 512, 514, 518 and 520 that are carried by inner shell 514. The rollers allow the spring to move relative to the shells. One roller 512 is shown in FIG. 13C; the roller can move within retainers 530 and 531 that are fastened to the shell. Other mechanical means of carrying rollers or equivalent structures over which the spring can move (such as a low-friction stationary surface) are also contemplated herein.

Device 500 further includes mechanism 524 that allows for adjustment of the tension "T" on spring 510. In this non-limiting example this is accomplished with nip rollers 515 and 516, FIGS. 13A and 13B, through which elastomer 510 passes. The nip rollers grip the elastomer to hold it in place under normal loads expected under normal impacts that are expected. Rollers 515 and 516 are coupled such that they move in unison and in opposite directions, in this case with meshed gears 545 and 546 that are each coupled to one of the rollers. This allows one roller to be turned to tighten or loosened the spring as a means to adjust the spring preload tension. A ratchet consisting of toothed wheel 545 that is coupled to one of the nip rollers, along with pawl 546, inhibits the elastomer from being pulled back through the nip rollers when impact on the outer shell occurs. End 551 of roller 515 is configured (e.g., with a hex nut) such that a torque wrench can be coupled to it, so that the pretension can be set as desired. This will allow the device to be calibrated to an initial preload force.

Pre-tensioning of the elastomer(s) helps to ensure that all shell motion occurring on impact results in stretching of the elastomer(s) (spring(s)) and absorption of impact energy. A second or more additional elastomers can be added in parallel with spring 510. This can have a higher or lower spring constant and can be pre-tensioned as desired. The multiple springs can be selected and tensioned to achieve a desired blended energy absorption result. For example, a second elastomer could have a higher spring constant and set such that it was stretched under greater impacts, to provide more damping during higher impact events.

Another option, not shown in the drawings, would be to include a circuit that recorded the number of impacts to the device that exceeded the energy-absorption capacity. This could be accomplished by including a network of conductors on the outside of the inner shell and on the inside of the outer shell, arranged such that electrical contact occurred between the two networks when the shells touched (which would happen when the energy absorption members were taxed beyond their capacity). A simple circuit would be included to both measure continuity and record the data; the circuit would likely include a battery and a controller with memory. The conductors could be accomplished with thin copper strips similar to ribbon cables, or other conductors. The conductors could be arranged in a criss-cross or hatched pattern such that electrical contact was made when the shells touched even if the alignment between the shells changed due to oblique blows that twisted the outer shell, and the like.

What is claimed is:

1. A helmet, comprising:

a first shell that is constructed and arranged to be placed on the head;

a second shell that substantially surrounds and is spaced from the first shell;

one or more energy absorption subassemblies located between the first and second shells, each energy absorption subassembly of the one or more energy absorption subassemblies comprising generally concentric spaced rings comprising an inner ring and an outer ring, and a plurality of elastomeric energy-absorption members mechanically coupled to both the inner ring and the outer ring and spanning the distance between the rings, wherein the plurality of energy-absorption members are spaced around at least most of the circumferences of the inner and outer rings;

each elastomeric energy-absorption member constructed as an elastomeric extension spring configured to resist a tensile load generated by the first shell that pulls along a direction of a length of the elastomeric energy-absorption member; and wherein the inner ring of each energy absorption subassembly is fixed to the outside of the first shell, and the outer ring of each energy absorption subassembly is fixed to the inside of the second shell;

each elastomeric energy-absorption member of the plurality of elastomeric energy-absorption members being disposed (i) at a first length between the first shell and the second shell in the absence of a load in an impact receiving location of the first shell and (ii) at a second length between the first shell and the second shell in the presence of a load in the impact receiving location, the second length of the elastomeric energy-absorption members located substantially within the impact receiving location being less than the first length of the elastomeric energy-absorption members located substantially within the impact receiving location, and the second length of the elastomeric energy-absorption members located at a location that is substantially opposite to the impact receiving location being greater than the first length of the elastomeric energy-absorption members located at the location that is substantially opposite to the impact receiving location.

2. The helmet of claim 1, wherein disposition of the elastomeric energy-absorption members at the location that is substantially opposite to the impact receiving location between the first length and the second length is configured to absorb energy in the presence of the load in the impact receiving location.

3. The helmet of claim 1, wherein for each elastomeric energy-absorption member of the plurality of elastomeric energy-absorption members disposed at a second length between the first shell and the second shell in the presence of a load in the impact receiving location, the second length of the elastomeric energy-absorption members located substantially within the impact receiving location being less than the first length of the elastomeric energy-absorption members located substantially within the impact receiving location, each elastomeric energy-absorption member comprises:

at least a first portion of the elastomeric energy-absorption member folded upon a second portion of the elastomeric energy-absorption member.

* * * * *